US005582466A

United States Patent [19]

Delli-Gatti, Jr.

[11] Patent Number: 5,582,466

[45] Date of Patent: Dec. 10, 1996

[54] ADVANCE/RETREAT CUTTING MINER WITH SIMPLE CONVEYOR

[75] Inventor: Frank A. Delli-Gatti, Jr., Beckley, W. Va.

[73] Assignee: Coaltex, Inc., Beckley, W. Va.

[21] Appl. No.: 500,040

[22] Filed: Jul. 10, 1995

[51] Int. Cl.[6] ..... E21C 27/22; E21C 41/00

[52] U.S. Cl. ..... 299/18; 299/57

[58] Field of Search ..... 299/18, 67, 57, 299/55, 59, 80, 83.1, 45, 71

[56] References Cited

U.S. PATENT DOCUMENTS

| | | | |
|---|---|---|---|
| 2,784,955 | 3/1957 | Compton . | |
| 3,395,941 | 8/1968 | Young et al. . | |
| 3,614,162 | 10/1971 | Teeter | 299/67 |
| 3,617,093 | 11/1971 | Daily | 299/80 |
| 3,700,285 | 10/1972 | Rollins | 299/83 |
| 3,773,384 | 11/1973 | Anderson | 299/76 |
| 3,804,466 | 4/1974 | Cilles | 299/78 |
| 3,907,368 | 9/1975 | Galis | 299/57 |
| 3,968,995 | 7/1976 | Arentzen | 299/76 |
| 4,003,602 | 1/1977 | Justice et al. . | |
| 4,160,566 | 7/1979 | McGee et al. . | |
| 4,668,016 | 5/1987 | Hart | 299/29 |
| 4,889,392 | 12/1989 | Justice et al. . | |

*Primary Examiner*—Frank Tsay
*Attorney, Agent, or Firm*—Nixon & Vanderhye P.C.

[57] ABSTRACT

A mining machine uses front cutters (barrel cutters) to cut into an area to be mined defining a first profile, and then expands rear cutters on the sides to cut a second, larger, profile during out-cutting. Cutter chains and drums of the rear cutter initially move cut material (e.g., coal) forward, and then through openings in the side frame of the machine onto a first, lowest, conveyance surface over which an endless conveyor chain with flights moves. A second conveyance surface above the first conveyance surface is also traversed by the chain with the flights to move material from the front cutters. A reversible motor powers the chains so that cut material is moved over the second conveyance surface during in-cutting, and over the first conveyance surface during out-cutting. The rear cutters are a sufficient distance above the mined floor formed during in-cutting that cut material tends to move onto (rather than under) the first conveyance surface. Each barrel cutter may be powered by the same explosion-proof electric motor as a rear cutter, with a remote controlled clutch between the motor and rear cutter so that the rear cutter need not operate during in-cutting.

20 Claims, 4 Drawing Sheets

ADVANCE/RETREAT CUTTING MINER WITH SIMPLE CONVEYOR

BACKGROUND AND SUMMARY OF THE INVENTION

In the development of mining machines, particularly for the mining of coal in seams, there have been a number of significant developments which have made the safe and efficient recovery of coal more feasible. For example in U.S. Pat. No. 4,003,602 a mining machine and method were disclosed in which a bore of one size is formed during in cutting using a single barrel cutter, and then by moving rear (wing) cutters outwardly the width of the bore is enlarged during out cutting, utilizing a single auger conveyor to conveyor the cut material. In U.S. Pat. No. 4,889,392 this basic concept was significantly improved upon by utilizing a pair of counter-rotating disc cutters, and re-orienting the rear cutters so that during cutting they initially imparted a forward vector to the cut material during out cutting and then desirably transferred the cut material onto a conveyor which continued movement of the cut material in a forward direction until it was deposited on a main rearwardly moving conveyor. With this system a cob cutter was provided and the bore going in was substantially rectangular. The machine described in the U.S. Pat. No. 4,889,392, particularly when used for high wall mining, allows a substantial force to be applied during advance, and does not cycle as do known commercial mining machines, and therefore is highly advantageous.

While the machine and method disclosed in U.S. Pat. No. 4,889,392 is highly advantageous, it is desirable that the cutting speed thereof be enhanced and that the conveying action thereof be simplified. Therefore according to the present invention a mining machine and method have been developed which achieve these desirable results, enhancing the cutting speed and simplifying the conveying action.

The cutting speed of the mining machine according to the present invention is significantly enhanced (i.e. is between about 75–100% greater) than the cutting speed in the U.S. Pat. No. 4,889,392 primarily by making a few simple changes in the front cutting means. According to the present invention the front cutting means preferably comprise a pair of counter-rotating barrel cutters (such as shown in U.S. Pat. Nos. 2,784,955 and 3,395,941, the disclosures of is which are hereby incorporated by reference herein) in place of the disc cutters, and a cutting chain behind the barrel cutters moving in a plane that is substantially perpendicular to the axes of rotation of the barrel cutters. Such a cutting chain is particularly useful when crawlers are used with the mining machine to advance the mining machine into the tunnel that it forms, and withdraw it from the tunnel. If crawler sections are utilized they are typically placed about every 500 feet along a trailing conveyor. The conveyor trailing the mining machine may be of any suitable conventional type including rubber belt sections, and conveyors such as shown in U.S. Pat. Nos. 5,056,655, 5,087,101, 5,129,502, and/or 5,152,389.

In order to maximize the effectiveness of the conveying action at the mining machine itself, according to the present invention a conveyance surface is provided close to the mine floor. In order to ensure that the cut material (e.g. coal) is properly moved to the conveyance surface rather than pushed under it, the rear (wing) cutters are constructed so that the bottom most portion thereof is approximately at or above the first conveyance surface (e.g. about 2–5 inches off of the mine floor). A reversible motor powers a conventional conveyor chain going over the first conveyance surface to move the cut material rearwardly during out cutting, and that same chain can move over an elevated, second, conveyor surface disposed in operative association with the front cutting means, with a reversible motor moving cut material rearwardly over the second conveyance surface during in cutting. The conveyor construction according to the present invention is thus simplified compared to that in U.S. Pat. No. 4,889,392, and highly advantageous in conveying action compared to that in U.S. Pat. No. 4,003,602.

According to one aspect of the present invention a mining machine for mining an area is provided which comprises the following components: A frame having a front, first and second sides, and a rear. A front cutting means mounted adjacent the front of the frame, and for cutting a volume of material to be mined, and forming a mine floor during cutting. At least two rear cutters located closer to the rear of the frame than is the front cutting means, one rear cutter mounted to each of the frame sides so that it is movable from a first non-cutting position within the volume cut by the front cutting means, to a second, operative, position in which it is outside at least a portion of the volume cut by the front cutting means. A first conveying element mounted by the frame above the mine floor formed by the front cutting means at a position for receipt of material cut by the rear cutters and positioned so that material cut by the rear cutters is moved onto the conveying element for conveyance away from the mined area. And, the rear cutters having bottom-most portions and top portions, and the rear cutters also mounted so that the bottom-most portions thereof are substantially at or above the first conveying element, and above the mine floor.

While the front cutting means may comprise disc cutters or any other type of conventional cutting heads for mining machines, in the preferred embodiment according to the present invention the front cutting means includes a pair of counter-rotating barrel cutters, and preferably also a cutting chain and moving in a plane substantially perpendicular to the axes of rotation of the barrel cutters. Typically first and second barrel cutters and first and second rear cutters are provided, and the first barrel cutter and the first rear cutter are powered by a first explosion proof electric motor while the second barrel cutter and the second rear cutter are powered by a second explosion proof electric motor. A first remote control clutch is provided between the first motor and the first rear cutter and a second remote control clutch between the second motor and the second rear cutter.

The mining machine also preferably further comprises a second conveying element mounted by the frame above the first conveying element and positioned with respect to the front cutting means to convey material cut therefrom away from the mined area. Also crawlers are preferably mounted to the frame for powering the frame into and out of the tunnel formed by the front cutting means and material to be mined. The first and second conveyance elements preferably comprise first and second conveyance surfaces traversed by an endless conveyor chain with connected conveyor flights, the chain powered by a reversible motor. The first and second conveyance surfaces terminate at different levels adjacent the rear of the frame, and the mining machine further comprises conveying means for conveying cut material away from the termination of the first and second conveying surface away from the mined area, such conveying means such as described above with respect to U.S. Pat. Nos. 5,056,655, etc.

The sides of the frame of the mining machine of the invention include elongated openings allowing the passage of material cut by the rear cutters therethrough and onto the first conveying surface. Also the sides of the frame may include forward frame side portions and rear frame side portions, the rear frame side portions pivotally mounted for limited pivotal movement about an axis substantially perpendicular to the frame sides, and the rear frame side portions including the elongated openings therein. Typically a shaft extends between the rear frame side portions and mounts a drive sprocket, and the reversible motor is mounted to one of the rear frame side portions and connected to the shaft mounting the drive sprocket by a telescoping drive. In the preferred embodiment the rear cutter bottom-most portions are about 2–5 inches above the mine floor.

The invention also relates to a method of mining material in an area where no operator will be present. The method comprises the following steps: (a) Cutting into the area to be mined using a mining machine by moving the mining machine in a forward direction, to form a bore having given first dimensions. (b) Removing cut material as the mining machine is moved in the forward direction by moving the material rearwardly out of the area being mined. (c) Terminating forward movement into the area being mined, and then moving the mining machine rearwardly out of the bore while continuing to cut material so as to enlarge the bore from the first dimensions to second dimensions greater than the first dimensions. And, (d) conveying the material cut during rearward movement first in a forward direction, and then ultimately rearwardly so that it moves out of the area being mined in the same manner that the material cut during forward movement is moved out of the area being mined, and wherein step (d) is practiced by cutting the material during rearward movement with cutting chains and drums moving in a direction so as to impart a significant forward force vector to the cut material to push the cut material onto a first rearwardly moving conveyor surface, and moving the cut material on the first conveyor surface rearwardly out of the area being mined.

The method preferably also uses the second conveyor surface vertically above the first conveyor surface, and a common endless chain conveyor moves over the first and second conveyor surfaces powered by a reversible motor. Step (b) is practiced by operating the reversible motor so that the endless chain conveyor moves cut material rearwardly over the second conveyor surface, and step (d) is further practiced by reversing the reversible motor compared to its operation during the practice of step (b), and operating the reversible motor so that the endless chain conveyor moves cut material rearwardly over the first conveyor surface. Step (a) is practiced to form a first mine floor, and step (c) is practiced to cut material with the cutting chain so that a second mine floor, exteriorly of the first mine floor, is formed thereby, the second mine floor being above the first mine floor a sufficient distance so that material cut by the cutting chains will tend to move onto—rather than under—the first conveyor surface.

According to another aspect of the present invention a mining machine for mining in an area is provided comprising the following elements: A frame having a front, first and second sides, and a rear. A front cutting means mounted adjacent the front of the frame, and for cutting a volume of material to be mined, and forming a mine floor during cutting. At least two rear cutters located closer to the rear of the frame than is the front cutting means, one rear cutter mounted to each of the frame sides so that it is movable from a first non-cutting position within the volume cut by the front cutting means, to a second, operative, position in which it is outside at least a portion of the volume cut by the front cutting means. A first conveying element mounted by the frame above the mine floor formed by the front cutting means at a position for receipt of material cut by the rear cutters and positioned so that material cut by the rear cutters is moved onto the conveying element for conveyance away from the mined area. A second conveying element mounted by the frame above the first conveying element, and positioned with respect to the front cutting means to convey material cut therefrom away from the mined area. And, wherein the first and second conveying elements comprise first and second vertically spaced conveyance surfaces traversed by an endless conveyor chain with connected conveyor flights, the chain powered by a reversible motor so that cut material is moved along the first conveyance surface during rearward movement of the frame, and along the second conveyance surface during forward movement of the frame. The details of the conveyance surfaces, and a frame, etc. are preferably as described above.

According to yet another aspect of the present invention a mining machine for mining an area is provided that comprises the following components: A frame having a front, first and second sides, and a rear. A front cutting means including a pair of substantially parallel counter-rotating barrel cutters mounted to the front of the frame and for cutting a volume of material to be mined, and forming a mine floor during cutting. At least two rear cutters located closer to the rear of the frame than is the front cutting means, one rear cutter mounted to each of the frame sides so that it is movable from a first non-cutting position within the volume cut by the front cutting means, to a second, operative, position in which it is outside at least a portion of the volume cut by the front cutting means. And, a non-auger conveyor mounted between the frame sides for conveying material cut by the barrel cutters and the rear cutters away from the barrel cutters. Other components of the front cutting means are preferably as described above, and crawlers are preferably provided.

It is the primary object of the present invention to provide for the efficient and cost-effective removal of mined material from a seam, such as coal, using in cutting and separate out cutting techniques. This and other objects of the invention will become clear from an inspection of the detailed description of the invention and from the appended claims.

DETAILED DESCRIPTION OF THE DRAWINGS

Figure 1:
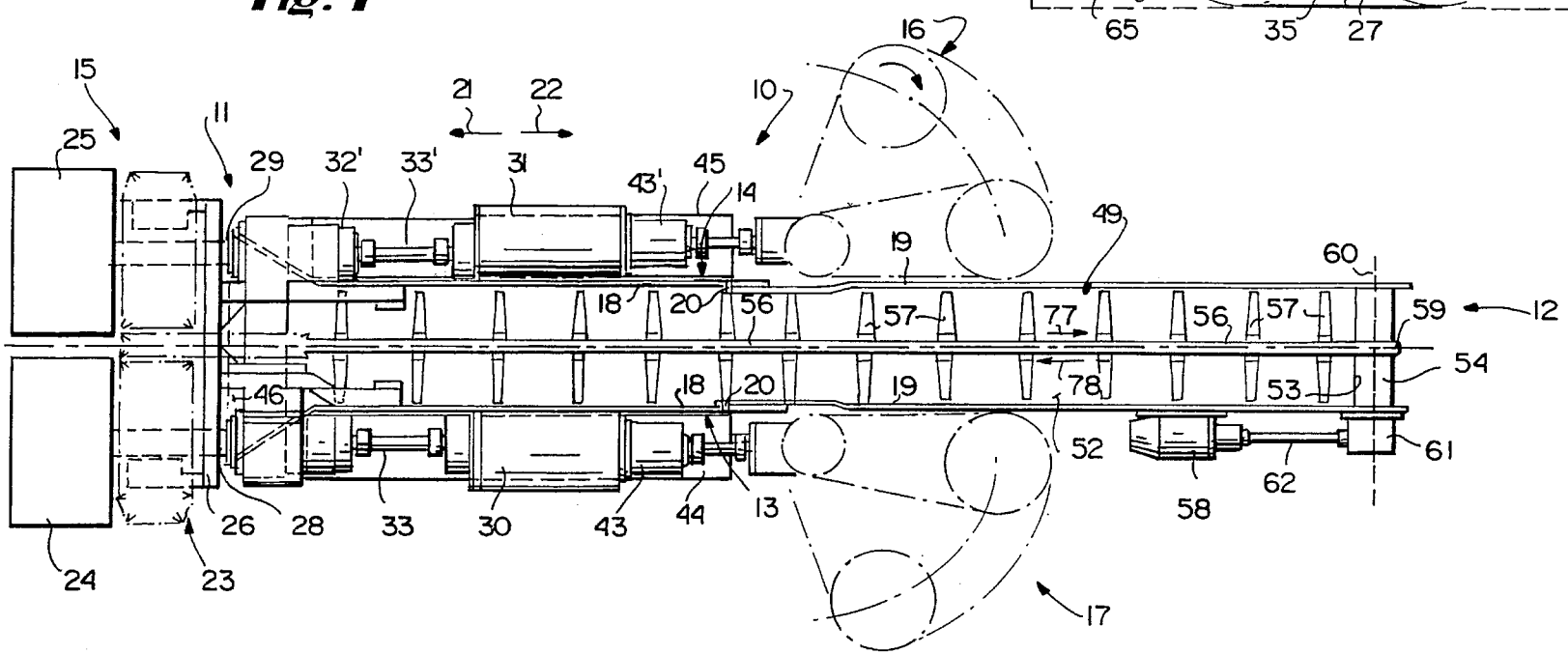
FIG. 1 is a top plan schematic view of an exemplary mining machine according to the present invention.
Figure 2:
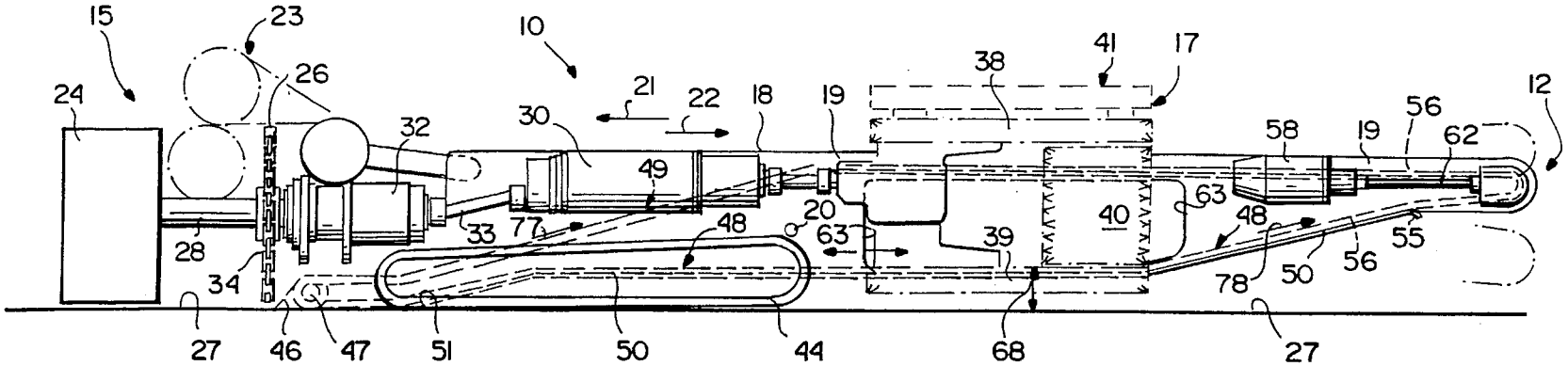
FIG. 2 is a side elevational schematic view of the mining machine of FIG. 1.

An exemplary mining machine shown generally by reference numeral 10 in FIGS. 1 and 2 is similar in concept to and functions in a manner generally the same as, the machine shown in U.S. Pat. No. 4,889,392 (the disclosure of which is hereby incorporated by reference herein) while having an enhanced advance rate during in cutting, and having a simplified, versatile, and practical conveyance mechanism. The basic elements of the machine 10 include a steel frame having a front 11, rear 12, and first and second sides 13, 14, a front cutting means shown generally by reference numeral 15, and at least two rear (wing) cutters (and preferably only two rear cutters) 16, 17. As schematically illustrated in FIGS. 1 and 2, the sides 13, 14 each preferably include a forward frame side portion 18 and a rear frame side portion 19, the portions 18, 19 connected together by pivot pins 20 for limited pivotal movement about a substantially horizontal axis substantially perpendicular to the in cutting direction 21 and the out cutting direction 22. Alternatively the frame sides 13, 14 can be rigid. In either case, the frame sides 13, 14 are typically made of steel plate.

The front cutting means 15 according to the present invention may include disc cutters, cob cutters, such as the cob cutter 23 schematically illustrated in FIGS. 1 and 2, and a wide variety of other cutters in place of or in addition to disc cutters or cob cutters and the like. Almost any conventional cutting heads may be utilized. However in the preferred embodiment according to the present invention the front cutting means 15 includes a pair of counter-rotating barrel cutters 24, 25. The barrel cutters 24, 25 are well known per se for use with augers, and are shown in U.S. Pat. Nos. 2,784,955 and 3,395,941 (the disclosures of which are hereby incorporated by reference herein), but heretofore have not been utilized significantly except in association with augers. However it has been found according to the present invention that when a pair of counter-rotating barrel cutters 24, 25 of substantially the same size are utilized in the machine 10 in place of the disc cutters 18 illustrated in U.S. Pat. No. 4,889,392 that the penetration rate during in cutting (in direction 21) is about 75–100% faster with all other features remaining the same.

The front cutting means 15 also preferably comprises a front cutting chain 26 for substantially smoothly forming the mine floor 27 (see FIG. 4) formed by the machine 10. The barrel cutters 24, 25 are driven by shafts 28, 29 powered by explosion-proof first and second electric motors 30, 31 mounted to the side frames 13, 14 as illustrated in FIG. 1. A gear box 32 is also preferably provided between the motor 30 and the shaft 28, the gear box 32 connected to the motor 30 by shaft 33 as seen in FIG. 2, and a similar gear box and shaft 32', 33' between the motor 31 and shaft 29. The cutting chain 26 is powered by one of the shafts 28, 29, e.g. by a drive sprocket schematically illustrated at 34 in FIG. 2 (in this embodiment on the shaft 28). A similar, idler, sprocket is provided mounted on the other shaft 29. The bearing connection between the idler sprocket and the shaft 29 allows drive of the chain 26 only by the shaft 28 and drive sprocket 34. In addition to (or alternatively to) substantially smoothly forming the mine floor 27, the cutting chain 26 also serves to assist in breaking up any intervening mined material (e.g. coal) remaining in the volume 35 (see FIG. 4) between the bores 36 cut by the barrel cutters 24, 25.

The rear cutters 16, 17 are substantially identical to those in U.S. Pat. No. 4,889,392, also being shown in more detail in FIG. 5 and including having hydraulic cylinders 37 (see FIG. 5) associated therewith for moving them between the retracted position illustrated in solid line in FIG. 5 and the cutting position illustrated in dotted line in FIG. 5. The cutters 16, 17 include cutting chain 38, 39 (see FIG. 2) at the top and bottom-most portions thereof, as well as a cutting drum 40. Also—shown schematically only by reference numeral 41 in FIG. 2—each of the cutters 16, 17 may include pineapple cutters, such as are well known per se. The cutters 16, 17 have the directions of rotation illustrated by arrows 42, 42' in FIG. 5 so that when the material being mined is cut thereby, with the cutters 16, 17 in the dotted line (or even more widely extended) positions illustrated in FIG. 5, the cut material will initially flow with a significant forward vector (in direction 21) as the machine 10 is being moved in the rearward direction 22.

The cutters 16, 17 are powered by the motors 31, 30, respectively. However according to the present invention it is desirable that the cutters 16, 17 not operate during in cutting (in direction 21). This is accomplished by utilizing the planetary clutches 43, 43' operated by remote control from the mine mouth. While an additional set of clutches between the motors 30, 31 and the barrel cutters 24, 25 could also be provided, that would add a significant amount of additional weight and complication without returning the same level of benefits as are obtained by disengaging the rear cutters 16, 17 during forward movement (in direction 21).

While the machine 10 may be sumped in and out of the mine (as is the machine in the preferred embodiment in the U.S. Pat. No. 4,889,392), in the preferred embodiment here conventional crawlers, 44, 45, may be utilized to move the machine 10 both in directions 21, 22, the crawlers 44, 45 also remotely operated from the mine site and including conventional explosion-proof electric motors, tracks, and the like. If crawlers 44, 45 are utilized, the out-of-mine conveyors utilized with the machine 10 (which will be hereinafter further described) typically have crawler sections mounted every about 500 feet.

Figure 3:
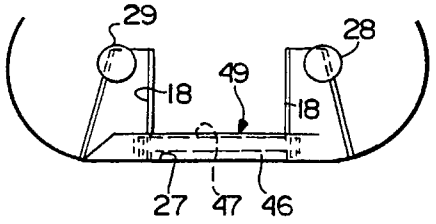
FIG. 3 is a front detail view behind the front cutting means showing the ramp/shovel construction adjacent the second conveyor surface for the mining machine of FIGS. 1 and 2.

According to the present invention, conveyance of cut material from the front cutting means 15 on the machine 10 during movement in the direction 21 is preferably provided by utilizing a ramp or shovel 46 (see FIG. 3 in particular) mounted by the frame front side portions 18, and disposed in front of an idler roller and/or lo sprocket 47 so as to cam cut material from the mine floor 27 onto a conveyance element. In the preferred embodiment according to the present invention two distinct (though using some common elements) conveyance elements are provided, a first, bottom-most, conveyance element shown schematically by reference numeral 48 in FIG. 2, and a second, uppermost, conveyance element shown schematically by reference numeral 49 in the drawings.

While a wide variety of different conveyance elements/mechanisms 48, 49 can be utilized, including all sorts of conventional chains, flights, drags, belts, or the like, in the preferred embodiment, however, the lower, first, conveyance element 48 preferably comprises a steel plate conveyance surface—only a portion of which is seen in solid line at 50 in FIG. 2, but which continues as shown in dotted line in FIG. 2. In the exemplary embodiment illustrated in the drawings the plate/surface 50 terminates at a forward point at approximately 51 in FIG. 2 near the front of the crawler 44. Similarly the upper, second, conveyance element 49 comprises the metal plate/conveyance surface 52 (best seen in FIGS. 1, 6, and 7). The second plate/conveyance surface 52 has a front end termination not clearly visible in FIGS. 1 and 2, but just in back of the ramp/shovel 46, and has a rear termination 53 (best seen in FIGS. 1, 6, and 7) substantially at the drive roller/sprocket 54. The rear termination of the plate 50 is a downwardly turned portion seen most clearly at 55 in FIGS. 2, 6 and 7.

A suitable joint configuration (not shown) may be provided in plate 19 to accommodate pivoting about pins 20 (if employed).

Cooperating with the plates 50, 52 may be a wide variety of conveyance elements. The preferred conveyance element, illustrated in and described with respect to FIG. 7 in the U.S. Pat. No. 4,889,392, and clearly seen in FIGS. 1, 6, and 7 herein, is the conveyor chain 56 having a plurality of flights 57 associated therewith, the endless chain 56 being driven by a reversible electric motor 58. Mounted on the drive roller/sprocket 54 is the sprocket portion 59 (see FIGS. 1, 6, and 7) which engages and drives the chain 56. The roller 54 and sprocket 59 are rotated about an axis of rotation 60 substantially perpendicular to the directions 21, 22 and defined by an interior shaft portion of the roller 54. That shaft portion extends between the side wall portions 19 (as seen in FIG. 1) and is received by conventional bearings (not shown) in each of the side wall portions 19 and is driven by a gear box 61 (see FIG. 1). A telescoping/splined drive 62 extends between the motor 58 and the gear box 61 for situations when the rear side frame portions 19 are mounted by the pivot pins 20.

As seen in FIG. 2, the side wall portions 19 also have elongated openings 63 formed therein. The openings 63 are provided to allow material cut by the rear cutters 16, 17 exteriorly of the volume defined by the frame sides 13, 14, to move inwardly into operative association with the first conveyance element 48.

Figure 4:
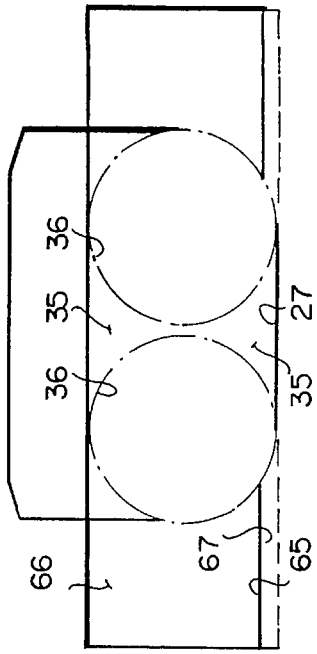
FIG. 4 is a schematic end view of an exemplary tunnel formed in a coal seam utilizing the method and apparatus according to the present invention.

As seen most clearly with respect to FIGS. 2 and 4, the rear cutters 16, 17 bottom-most portions 39 are mounted so that they are substantially at or above the first conveying surface 50 and above the mine floor 27. This results in a second mine floor 65 (see FIG. 4) in the volume 66 cut by the wing cutters 16, 17 that is a distance 67 above the main mine floor 27. The distance 67 is approximately the height of the first conveyance surface 50 (and bottom of openings 63) above the mine floor 27, at the openings 63, as illustrated at 68 in FIG. 2. This distance 68 for mining machines 10 having cutter heads 24, 25 of about 36–50 inches in diameter would be about two to five inches, e.g. about three inches. This means that the material cut by the wing cutters 16, 17 will tend to move the cut material onto the first conveyor element 48/first plate 50, rather than under it. While the volume of material between the second mine floor 65 and an extension of the first mine floor 27 as seen in FIG. 4 is lost compared to the cut volumes seen in FIG. 4 of the U.S. Pat. No. 4,889,392, this loss of material is more than compensated for by more efficient conveyance action and simplicity of the mining machine 10 according to the invention.

The machine 10 according to the present invention may also include a wide variety of other structures, such as skids provided underneath the frame portions 14 (mounted on shock absorbers or the like if the pivot pins 20 are utilized), and various other bearings, thrusts, drives, and the like such as shown in U.S. Pat. No. 4,889,392. Also instead of the crawlers 44, 45, movement in and out of the tunnel in the directions 21, 22 may be accomplished by conventional sumping means, for example connected to the structures 70 schematically illustrated in the embodiment of FIG. 5.

The pivotal movement of the frame portions 19 with respect to the frame portions 18 about the pivot pins 20, if utilized, may be accomplished utilizing conventional hydraulic cylinders operable between the portions 18, 19 but not shown in the drawings since they would be located under the conveyance plate 52 illustrated in FIG. 1. Any suitable connections may be provided for moving the rear end 12 of the frame—and the associated conveyor chain 56 and the like—to the dotted line positions illustrated in FIG. 2. To accommodate this movement, as earlier described, the shaft 62 may telescope, and any desired movement of the chain 56 may be accommodated by the conventional slack provided in an endless chain of the length of the chain 56 illustrated in the drawings. The purpose of being able to move the rear 12 to the dotted line positions illustrated in FIG. 2—if desired—is to accommodate seams of different heights and different out-of-mine conveyor mechanisms.

Figure 5:
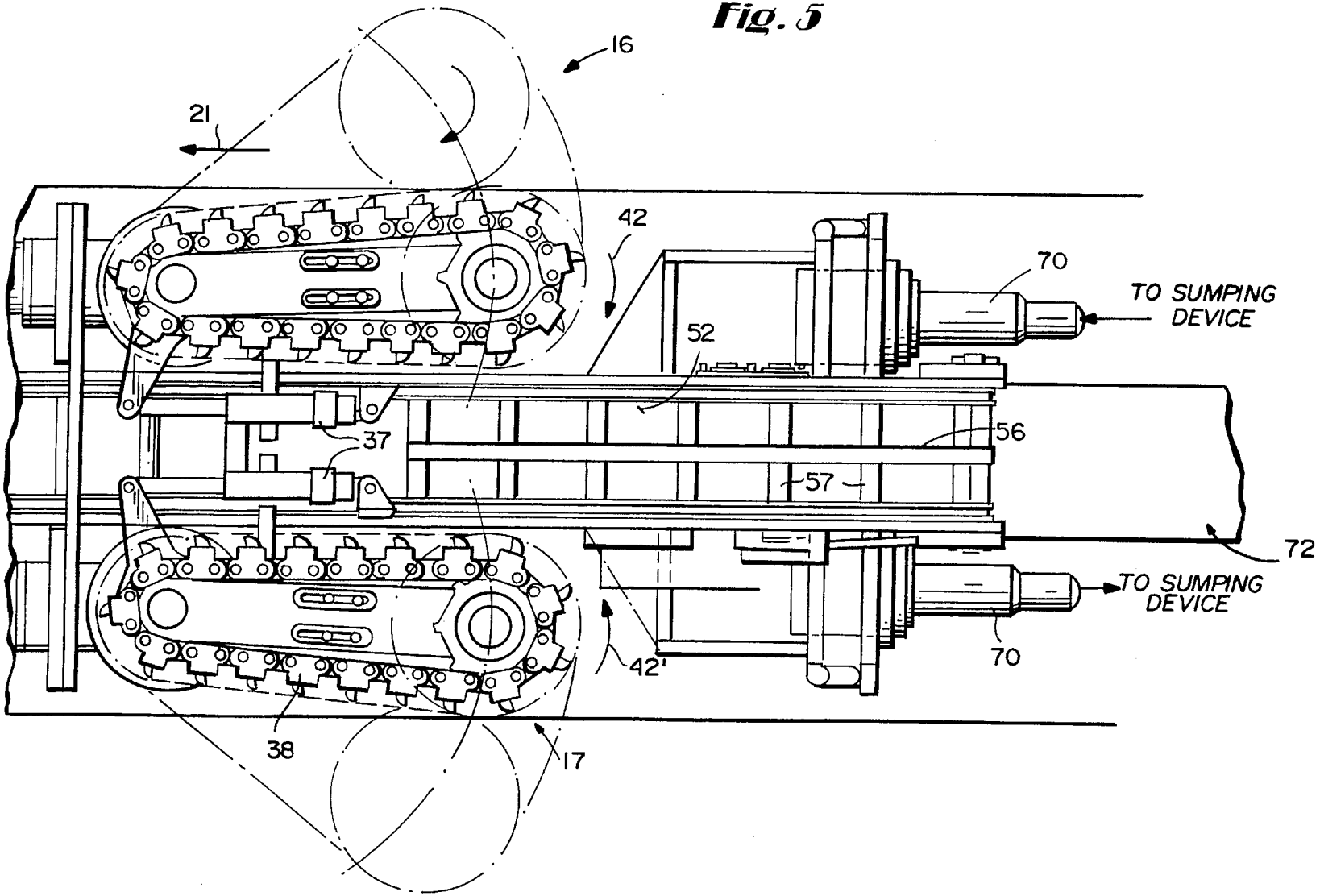
FIG. 5 is a partial top plan view showing the details of the rear (wing) cutters of the machine of FIGS. 1 and 2 and showing an alternative embodiment for moving the machine into and out of the tunnel formed thereby.
Figure 6:
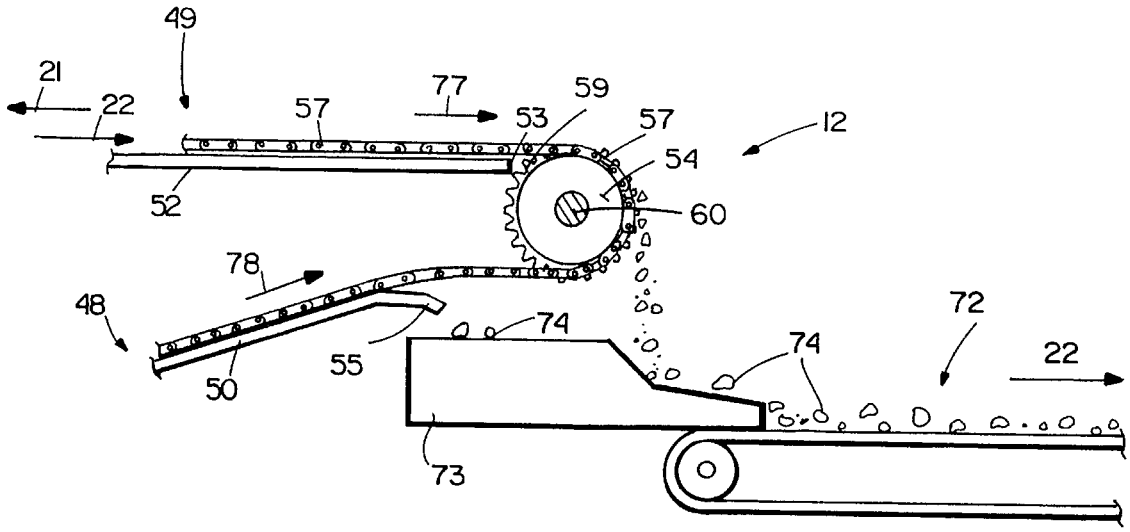
FIGS. 6 and 7 are detail schematic side elevational views of two different embodiments illustrating the relationship between an out-of-tunnel conveyor and the mining machine of FIGS. 1 and 2.
Figure 7:
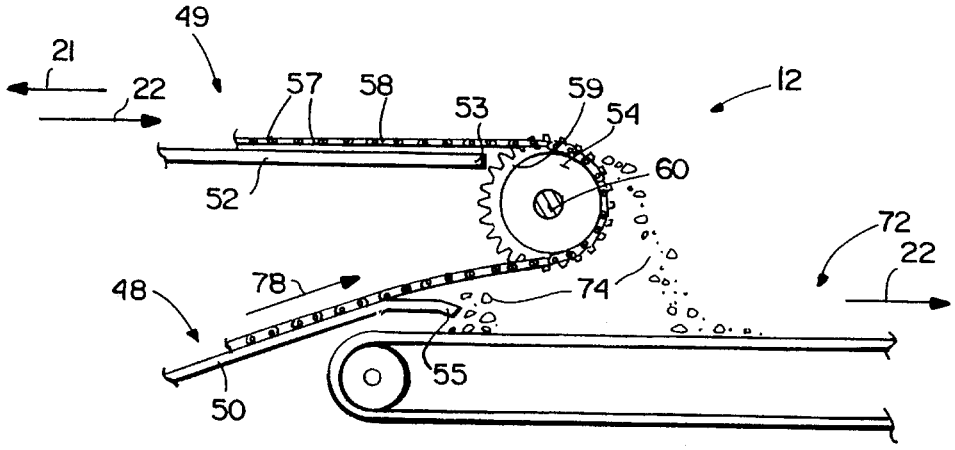

FIGS. 5 through 7 illustrate, schematically, different out-of-mine conveyor mechanisms that may be utilized. These out-of-mine conveyor mechanisms are shown only schematically by reference numeral 72 in each of FIGS. 5 through 7. It is to be understood that the out-of-mine conveyor mechanisms 72, which move the cut coal or the like from the mining machine 10 to the mine mouth, may be any known or conventional conveyor mechanisms that are suitable, including rubber belt sections, augers, or the conveyor mechanisms as shown in U.S. Pat. Nos. 5,056,655, 5,087,101, 5,129,502, and/or 5,152,389. As earlier indicated various powering and/or supporting units, such as crawlers, or skids, are provided at spaced locations along such conveyors 72.

FIGS. 6 and 7 illustrate clearly that the top conveyor element 49 discharges at a different location with respect to the rear 12 of the frame of the machine 10 than does the bottom conveyor element 48. As seen in FIG. 6, both of the elements 48, 49 may discharge into a pan 73 or the like, which pan 73 may be mounted to the frame sides 13, 14 and/or by skids, or mounted with the conveyor mechanism 72. From the pan 73 the cut material 74 ultimately flows so onto the conveyor 72. In the FIG. 7 embodiment, the conveyor 72 is shown extended, and the cut material 74 discharges directly onto it.

While FIGS. 6 and 7 show cut material 74 being discharged from both the conveyor elements 48, 49, it is to be understood that this is a schematic representation for clarity of illustration only, and that in fact cut material will be discharged by only one of the conveyor elements 48, 49 at a time, depending upon the direction of movement of the machine 10.

OPERATION

In a typical operation of the machine 10, the motors 30, 31 are operated to power the front cutting means 15, explosion-proof motors associated with the crawlers 44, 45 are also operated so as to move the machine 10 in the direction 21, and the clutches 42, 43 are operated so as to disengage the wing cutters 16, 17 from the motors 30, 31. The reversible motor 58 is operated so as to drive the chain 56 in the direction 77 (see FIGS. 2 and 6) so that coal or like mined material cut by the barrel cutters 24, 25, the cutting chain 26, and/or the cob cutter 23, is cammed up on ramp/shovel 46 to the top of idler 47 and onto the second conveyance surface 52, and then is moved by the flights 57 in the direction 77 until the coal reaches the rear 12 of the frame, and roller 54 thereat, the cut material 74 then falling from the machine 10 onto the pan 73 or directly onto the out-of-mine conveyor mechanism 72, and then being conveyed out of the mine in the direction 22. In this way the first mine floor 27 is formed.

Once the machine 10 has penetrated the seam of mined material a desired distance (e.g. 500 to 2000 feet), the crawler 44, 45 motors are remotely operated to reverse movement of the machine 10 so that it moves in the direction 22, the hydraulic cylinders 37 (see FIG. 5) are remotely controlled to move the wing cutters 16, 17 from a non-operable position along the frame sides 13, 14 and within the volume cut by the front cutting means 15, to an operative position (extreme position in FIG. 1 and dotted line position in FIG. 5), and the clutches 42, 43 are remotely operated to engage the drive for the cutters 16, 17 so that they are driven by the motors 30, 31. Also the motor 58 is remotely operated to reverse the direction of movement of the chain 56 so that it moves in the direction 78, opposite the direction 77.

During movement in the direction 22, and out cutting by the machine 10, the volumes 66 (see FIG. 4) are mined and the second mine floor 65 is formed. Coal or like mined material cut by the cutters 16, 17 is moved with a velocity component in the direction 21, as well as toward the sides 13, 14, and passes through the elongated openings 63 in the frame portions 19 onto the top of the plate 50, being engaged by the flights 57 of the chain 56 moving in the direction 78. The coal is then conveyed in the direction 78 until the rear end termination 55 of the plate 50 is reached, at which point the cut coal 74 is then deposited onto the pan 73, or directly onto the out-of-mine conveyor 72 as seen in FIGS. 6 and 7. The conveyors 72 always operate to move the material 74 out of the tunnel/mine formed by the machine 10, that is in the direction 22 as seen in FIGS. 6 and 7. Because of the positioning of the bottom-most portions 39 of the cutters 16, 17, the cut material 74 readily moves through the openings 63 onto the plate 50, rather than being forced thereunder.

It will thus be seen that according to the present invention an advantageous method and apparatus have been illustrated for the efficient and versatile mining of coal or other materials. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A mining machine for mining an area, comprising:

a frame having a front, first and second sides, and a rear;

a front cutting means mounted adjacent the front of said frame, and for cutting a volume of material to be mined, and forming a mine floor during cutting;

at least two rear cutters located closer to the rear of said frame than is said front cutting means, one rear cutter mounted to each of the frame sides so that it is movable from a first non-cutting position within the volume cut by said front cutting means, to a second, operative, position in which it is outside at least a portion of the volume cut by said front cutting means;

a first conveying element mounted by said frame above the mine floor formed by said front cutting means at a position for receipt of material cut by said rear cutters and positioned so that material cut by said rear cutters is moved onto said conveying element for conveyance away from the mined area; and said rear cutters having bottom-most portions and top portions, and said rear cutters also mounted so that said bottom-most portions thereof are substantially at or above said first conveying element, and above the mine floor.

2. A mining machine as recited in claim 1 wherein said front cutting means includes a pair of counter-rotating barrel cutters.

3. A mining machine as recited in claim 2 wherein first and second barrel cutters and first and second rear cutters are provided; and wherein said first barrel cutter and said first rear cutter are both powered by a first explosion proof electric motor, and said second barrel cutter and said second rear cutter are both powered by a second explosion proof electric motor; and further comprising a first remote-controlled clutch between said first motor and first rear cutter, and a second remote-controlled clutch between said second motor and said second rear cutter.

4. A mining machine as recited in claim 2 wherein said front cutting means further includes a cutting chain moving in a plane substantially perpendicular to the axes of rotation of said barrel cutters.

5. A mining machine as recited in claim 4 further comprising crawlers mounted to said frame for powering movement of said frame into and out of a tunnel formed by said front cutting means in material to be mined.

6. A mining machine as recited in claim 1 further comprising a second conveying element mounted by said frame above said first conveying element, and positioned with respect to said front cutting means to convey material cut therefrom away from the mined area.

7. A mining machine as recited in claim 3 wherein said first and second conveying elements comprise first and second conveyance surfaces traversed by an endless conveyor chain with connected conveyor flights, said chain powered by a reversible motor.

8. A mining machine as recited in claim 7 wherein said first and second conveyance surfaces terminate at different levels adjacent the rear of said frame; and further comprising conveying means for conveying cut material away from said terminations of said first and second conveyance surfaces away from the mined area.

9. A mining machine as recited in claim 7 wherein said sides of said frame include elongated openings therein allowing the passage of material cut by said rear cutters therethrough and onto said first conveyance surface.

10. A mining machine as recited in claim 9 wherein said sides of said frame include forward frame side portions and rear frame side portions, said rear frame side portions pivotally mounted for limited pivotal movement about an axis substantially perpendicular to said frame sides, said rear frame side portions including said elongated openings therein; and further comprising a shaft extending between said rear frame side portions and mounting a drive sprocket; and wherein said reversible motor is mounted to one of said rear frame side portions and connected to said shaft by a telescoping drive.

11. A mining machine as recited in claim 1 wherein said rear cutter bottom-most portions are about 2–5 inches above the mine floor.

12. A method of mining material in an area where no operator will be present, comprising the steps of:

(a) cutting into the area to be mined using a mining machine by moving the mining machine in a forward direction, to form a bore having given first dimensions;

(b) removing cut material as the mining machine is moved in the forward direction by moving the material rearwardly out of the area being mined;

(c) terminating forward movement into the area being mined, and then moving the mining machine rearwardly out of the bore while continuing to cut material so as to enlarge the bore from said first dimensions to second dimensions greater than said first dimensions; and (d) conveying the material cut during rearward movement first in a forward direction, and then ultimately rearwardly so that it moves out of the area being mined in the same manner that the material cut during forward movement is moved out of the area being mined, and wherein step (d) is practiced by cutting the material during rearward movement with cutting chains and drums moving in a direction so as to impart a significant forward force vector to the cut material to push the cut material onto a first rearwardly moving conveyor surface, and moving the cut material on the first conveyor surface rearwardly out of the area being mined.

13. A method as recited in claim 12 using a second conveyor surface vertically above the first conveyor surface, and wherein a common endless chain conveyor moves over the first and second conveyor surfaces powered by a reversible motor; and wherein step (b) is practiced by operating the reversible motor so that the endless chain conveyor moves cut material rearwardly over the second conveyor surface; and wherein step (d) is further practiced by reversing the reversible motor compared to its operation during the practice of step (b), and operating the reversible motor so that the endless chain conveyor moves cut material rearwardly over the first conveyor surface.

14. A method as recited in claim 13 wherein step (a) is practiced to form a first mine floor; and wherein step (c) is practiced to cut material with the cutting chains and drums so that a second mine floor, exteriorly of the first mine floor, is formed thereby, the second mine floor being above the first mine floor a sufficient distance so that material cut by the cutting chains and drums will tend to move onto, rather than under, the first conveyor surface.

15. A mining machine for mining an area, comprising:

a frame having a front, first and second sides, and a rear;

a front cutting means mounted adjacent the front of said frame, and for cutting a volume of material to be mined, and forming a mine floor during cutting;

at least two rear cutters located closer to the rear of said frame than is said front cutting means, one rear cutter mounted to each of the frame sides so that it is movable from a first non-cutting position within the volume cut by said front cutting means, to a second, operative, position in which it is outside at least a portion of the volume cut by said front cutting means;

a first conveying element mounted by said frame above the mine floor formed by said front cutting means at a position for receipt of material cut by said rear cutters and positioned so that material cut by said rear cutters is moved onto said conveying element for conveyance away from the mined area;

a second conveying element mounted by said frame above said first conveying element, and positioned with respect to said front cutting means to convey material cut therefrom away from the mined area; and wherein said first and second conveying elements comprise first and second vertically spaced conveyance surfaces traversed by an endless conveyor chain with connected conveyor flights, said chain powered by a reversible motor so that cut material is moved along said first conveyance surface during rearward movement of said frame, and along said second conveyance surface during forward movement of said frame.

16. A mining machine as recited in claim 15 wherein said first and second conveyance surfaces terminate at different levels adjacent the rear of said frame; and further comprising conveying means for conveying cut material away from said terminations of said first and second conveyance surfaces away from the mined area.

17. A mining machine as recited in claim 15 wherein said sides of said frame include elongated openings therein allowing the passage of material cut by said rear cutters therethrough and onto said first conveyance surface.

18. A mining machine for mining an area, comprising:

a frame having a front, first and second sides, and a rear;

a front cutting means including a pair of substantially parallel counter-rotating barrel cutters mounted to the front of said frame and for cutting a volume of material to be mined, and forming a mine floor during cutting;

at least two rear cutters located closer to the rear of said frame than is said front cutting means, one rear cutter mounted to each of the frame sides so that it is movable from a first non-cutting position within the volume cut by said front cutting means, to a second, operative, position in which it is outside at least a portion of the volume cut by said front cutting means; and a non-auger conveyor mounted between said frame sides for conveying material cut by said barrel cutters and said rear cutters away from said barrel cutters.

19. A mining machine as recited in claim 18 wherein said front cutting means further includes a cutting chain for substantially smoothly forming the mine floor, and movable in a plane substantially perpendicular to the axes of rotation of said barrel cutters.

20. A mining machine as recited in claim 19 further comprising crawlers mounted to said frame for powering movement of said frame into and out of a tunnel formed by said front cutting means in material to be mined.

* * * * *